United States Patent [19]

Sloan

[11] Patent Number: 4,515,517

[45] Date of Patent: May 7, 1985

[54] WELL POINT SYSTEM AND APPARATUS

[76] Inventor: Albert H. Sloan, 4201 Kean Rd., Fort Lauderdale, Fla. 33314

[21] Appl. No.: 497,838

[22] Filed: May 25, 1983

[51] Int. Cl.[3] ..... F04B 49/04; F04B 23/08

[52] U.S. Cl. ..... 417/46; 417/199 A; 417/200; 417/360; 417/390; 415/185; 415/206

[58] Field of Search ..... 417/200, 199 A, 201, 417/375, 390, 360, 46, 47, 202; 415/185, 183, 206, 211

[56] References Cited

U.S. PATENT DOCUMENTS

| | | | |
|---|---|---|---|
| 1,981,965 | 11/1934 | Morgan | 417/200 |
| 1,995,812 | 3/1935 | Noble | 417/202 |
| 2,124,681 | 7/1938 | Jauch et al. | 417/200 |
| 2,297,001 | 9/1942 | La Bour | 415/211 |
| 2,675,762 | 4/1954 | Share | 417/202 |
| 2,730,955 | 1/1956 | Share | 417/202 |
| 2,925,952 | 2/1960 | Garve | 415/183 |
| 3,910,728 | 10/1975 | Sloan | 417/390 |

*Primary Examiner*—Carlton R. Croyle
*Assistant Examiner*—Peter M. Cuomo
*Attorney, Agent, or Firm*—James E. Nilles

[57] ABSTRACT

A well point pumping system including a series of well points installed in an area of the ground which is to be dewatered or dried out. This system and its apparatus include an enclosed tank which can be located closely adjacent the well points which are often in a dirty, wet and/or remote area which often has difficult access. Also, the dewatering areas may be located at different levels below the ground surface. Usually the apparatus is subjected to severe abuse from handling, being moved about or from other machinery in the area. Furthermore, it may be difficult to install or remove the apparatus. The present system and apparatus include an enclosed tank which is capable of withstanding abuse and which can be located in the dirty working area and remotely from its power source. The tank encloses an impeller type water pump assembly, and also encloses a vacuum pump and its drive motor which create the required vacuum in the tank to cause water to be inducted into the tank from the well points. The pump assembly within tank is disposed with its axis in a vertical direction with the pump eye opening upwardly so that water can flow by gravity into the pump eye. The pump assembly includes an impeller, its shaft, a fluid motor attached to and for driving the shaft and impeller, and a mounting plate for enabling the entire pump assembly to be removed from the tank as a unit. The assembly does not require any close tolerances or adjustments for its installation. A control valve is provided for turning the vacuum pump on or off and for also regulating the speed of the pump, the valve being actuated by a water level float control in the tank. The power source for the system and apparatus can be located geographically remotely from the tank and away from the dirty working area where it is not subjected to abuse.

22 Claims, 10 Drawing Figures

WELL POINT SYSTEM AND APPARATUS

BACKGROUND OF THE INVENTION

The invention pertains to a water pumping system and apparatus for pumping water out of the ground, for example, prior to excavating the area and which may include a series of well points installed in an area of the ground, which is to be dewatered or dried out. The dewatering areas may be located at different levels below the ground surface, and the apparatus is often subjected to severe abuse from handling, being moved about or from other machinery in the area. Furthermore, it may be difficult to install or remove the apparatus. The prior art apparatus of this general type is shown in my U.S. Pat. No. 4,029,438 which issued June 14, 1977. In that device the power system and pumping apparatus were located closely adjacent the work site; that is, closely adjacent the well points and area being dewatered. The equipment shown in that patent is expensive and also subjected to the hazards of the dirty and busy work area, the water pump axis is disposed horizontally, and the various components including a separate vacuum tank and pump therefor are all exposed. In addition, that equipment required close adjustment and tolerance between the various parts of the water pump assembly.

SUMMARY OF THE PRESENT INVENTION

The present invention provides a hydraulic well point system and apparatus in which the components are located within a virtually indestructible tank that can be located in the work area and closely adjacent the well points and header, for good efficiency of the pump, while the power source for the apparatus and system can be located remotely from the area where it is not subjected to abuse. The water pump is located in the tank and is of the closed impeller type having a vertical axis with the eye of the pump facing upwardly to permit the water to be fed by gravity into the pump, thereby eliminating surging and pump priming problems. The invention provides a pump assembly including the closed type impeller and its vertically extending shaft, power means connected to the upper end of the shaft for driving the impeller, an attaching plate for sealingly and removably mounting the assembly in the tank, and anti-vortex plates rigidly secured between the attaching plate and the bearing sleeve for the pump shaft, whereby the entire pumping unit can be easily removed from and attached to the interior of the tank. The pump shaft and its sleeve require no complex seals, and the pump assembly requires no fine tolerances or adjustments in order to insert or remove the assembly, and is easily repaired or its parts replaced.

A more limited aspect of the present invention provides a separate vacuum pump chamber in the tank and in which chamber the vacuum pump and its drive means are located. This vacuum pump chamber has an air communication with a water pump chamber of the tank for creating a vacuum in the water pump chamber to thereby cause water to be forced ("sucked") into the tank from the well points by the available atmospheric pressure. The vacuum pump has a remote speed control valve which is actuated by float control means in the tank. Furthermore, the invention provides a separate pump discharge chamber forming part of the tank and a one-way check valve means is located at the discharge side of the impeller pump and prevents water and air from returning from the discharge chamber and back into the interior of the tank. The outlet for the tank is from this discharge chamber.

The invention furthermore provides a tank of the above type which can be fabricated in three separate sections or chambers—namely, a pump chamber in the lower end of the tank and in which the pump assembly can be mounted, an intermediate water inlet chamber into which water is inducted ("sucked") and then fed by gravity into the eye of the pump, and an upper vacuum pump chamber in which the vacuum pump and its drive means are housed. Water is prevented from entering the vacuum pump area. The cooling and sealing oil separates from the vacuum pump discharge; however, it will maintain adequate air temperature to prevent the water vapor from condensing within the chamber.

The water pump provided by the present invention is of the closed impeller type having its axis arranged in a vertical direction and its eye facing upwardly so that the water feeds into the pump by gravity. The pump is furthermore of the sealless type, of low specific speed and driven hydraulically.

These and other objects and advantages of the present invention will appear hereinafter as this disclosure progresses, reference being had to the accompanying drawings.

DESCRIPTION OF A PREFERRED EMBODIMENT

Figure 1:
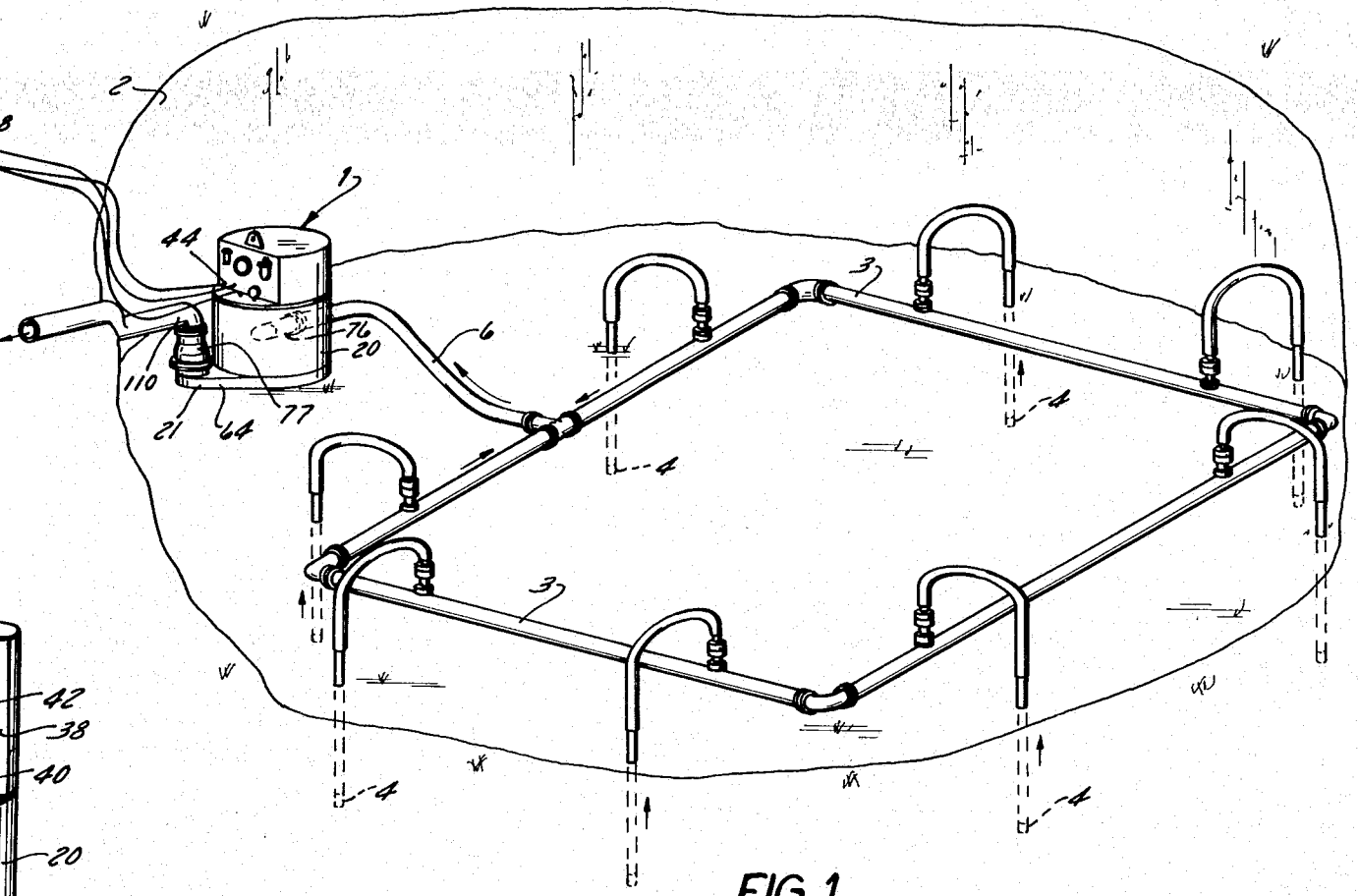
FIG. 1 is a perspective view of the water pump apparatus provided by the present invention as shown in the environment of an area to be dewatered.
Figure 2:
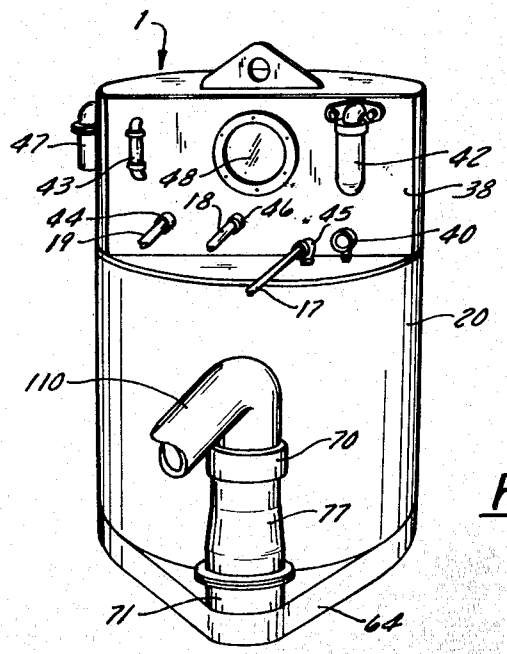
FIG. 2 is a perspective view of the water pump apparatus shown in FIG. 1 but on an enlarged scale.

The general organization of the apparatus is shown in FIG. 1 and includes the water pump apparatus 1 which is shown as being located in a pit or excavation 2 in the ground and which excavated area is to be dewatered. Conduit means 3 in the form of a closed loop constitutes a header which lies over the ground to be dewatered. A series of conventional well points 4 are connected at various locations to the header for delivering water from the ground to the header as is well known and as shown, for example, in my U.S. Pat. No. 4,029,438 issued June 14, 1977, and entitled "Well Point Pumping System and Pump Assembly Therefor". A water inlet conduit 6 conducts water from the header or conduit means 3 and to the interior of the water pump apparatus 1. The water is discharged from the apparatus via the water outlet conduit 8 for discharge in a remote location. Fluid power is provided for the apparatus from the mobile power source 10 which may be of the type which is located remotely from the excavated or working area, and this power source may be of the type shown in my U.S. Pat. No. 3,910,728 issued October 7, 1977, and entitled "Dewatering Pump Apparatus". It is believed sufficient to say for the purpose of this disclosure that the power source may include an internal combustion engine 11 which drives a hydraulic pump 12 that is encased in a cylinder 14, the latter acting as a reservoir for the hydraulic fluid. The power driven hydraulic pump 12 is connected by conduits 17, 18 and 19 to the water pump apparatus 1. Conduits 17 and 18 conduct pressure fluid such as oil from the pump 12 to a fluid motor for driving a water pump and to a fluid motor for driving a vacuum pump, respectively. Conduit 19 forms a common return of the oil from the apparatus to the tank 14 of the power source 10. The flow through conduit 17 to the motor 93, which may be a 30 hp motor, comprises about 75 percent of this flow of oil. The flow of oil to the vacuum pump motor 127, which may be only a 5 hp motor, comprises about 25 percent of the flow from the power source 10.

The water pump apparatus 1 includes a vacuum producing pump VP that acts to create a vacuum in the apparatus and thus inducts (commonly referred to as "sucks") the water from the well points, conduit means 3, and inlet conduit 6. Consequently, this pump apparatus 1 should be located closely to the ground being dewatered so as to minimize inefficiency due to leakage of air into the system through the numerous components, joints and fittings. The work area or "ditchline" in which the apparatus is located is often dirty, of difficult access and also has additional machinery working in the area and being moved about. As a result, the pump apparatus 1 is subjected to rough handling and other abuse. On the other hand, the mobile power source 10, which is relatively expensive and delicate, can be located at a remote, out-of-the-way location where it is not subjected to such abuse.

The pump apparatus 1 comprises tank means which may take different forms but preferably is formed as a generally cylindrical steel tank 20 having its major axis positioned in a generally vertical direction. The tank 20 has a tear-shaped bottom 21 and includes a lowermost pump discharge chamber 22, an intermediate water inlet chamber 24 and a vacuum pump chamber 26. The vacuum pump chamber has a plate 28 welded across its bottom. Chamber 24 has a ring plate 32 welded around its top edge. Bolt means 34 extend through the plate 28 and are threadably engaged in the ring plate 32, and thus detachable secure the vacuum pump chamber 26 to the water inlet chamber 24. An O-ring seal 33 provides a seal between the plate 28 and the ring plate 32. Plate 28 is welded, as indicated, to the side wall 36 which forms part of the upper pump chamber. It will be noted that the vertical front wall 38 of the upper chamber is flat so as to provide an instrument panel on which is mounted a vacuum pump oil filter 42, and a sight gauge 43 to permit viewing of the oil flowing when the unit is running, which oil is for lubricating, sealing and cooling, as will appear. The upper chamber has a hydraulic pressure fluid return fitting 44 for return conduit 19; fittings 45 and 46 for conduits 17 and 18 for conducting pressure fluid from the pump 12 of the power source are also located in the upper chamber. A vacuum gauge 40 is also located on the front of the tank. An air exhaust nozzle 47 extends from the side of the vacuum chamber wall and is used for exhausting air to the atmosphere from the chamber 26, and which air has been evacuated from the conduit means, well points and chamber 22. An access and sight window 48 is also provided in the instrument panel 38.

The water inlet chamber 24 is defined, in part, by a ring-like mounting plate 50 which is secured by bolts 50A around its periphery to a flange 51 welded to the lower inner end of cylindrical wall 20. This mounting plate 50 has a large central opening 52 for receiving a pump assembly to be described later.

Figure 5:
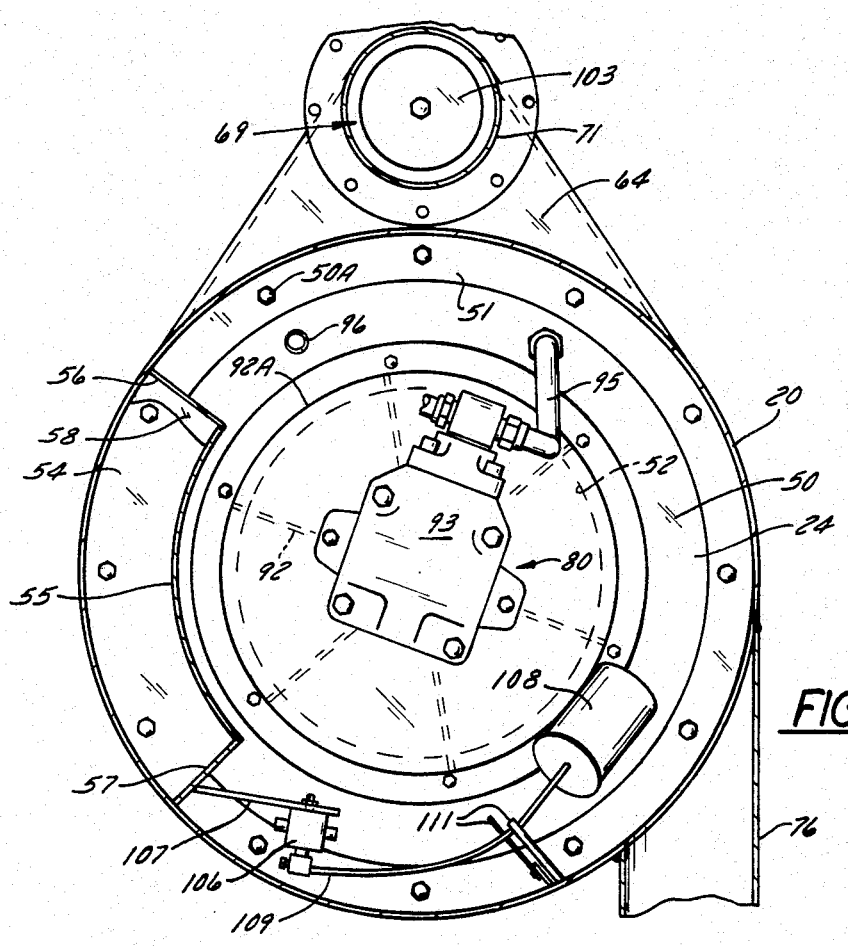
FIG. 5 is a horizontal cross-sectional view taken along line 5—5 in FIG. 3.

An arcuate-shaped oil cooler and reservoir 54 (FIGS. 5 & 10) is located inside the water inlet chamber 24 and is formed by a vertical arcuate wall 55, side walls 56 and 57, and an upper wall 58, and mounting plate 50 which defines the bottom of the reservoir. This oil cooler and reservoir 54 is connected by oil inlet conduit 60 and oil discharge conduit 61 (FIGS. 8 and 10) to the vacuum pump VP (FIGS. 3, 8 and 10) to be described, and for the purpose of continually passing oil through the vacuum pump so as to cool and lubricate its sliding vanes (not shown), and as described in said U.S. Pat.No. 4,190,400.

Water from the conduit 6 flows into the tangentially arranged inlet nipple 76 at the lower end of the chamber 24 and into the interior of the chamber 24. The tangential inlet causes the water to swirl around the inside of the tank and consequently air that has been entrained in the water has a chance to escape before it enters the impeller.

Located within the lower portion of the tank is a closed impeller type water pump assembly 80 (FIGS. 3, 4, 5 and 9). The impeller pump must work in a high vacuum environment and its impeller is designed specifically for this task. The pump is of the closed impeller type, has a large eye to diameter ratio, and is of a low specific speed. The pump comprises a closed impeller 82 having a plurality of curved blades 83 located between and welded to a lower plate 84 of the impeller and an inclined upper plate 85. Four such blades are shown having a wrap of about 167 degrees. The stainless steel blades 83 are tapered in height, having a leading edge of two inches, for example, and a trailing edge of one and one-fourth inches. The hub 86 of the impeller is secured to and held captive on the vertical impeller shaft 88. The shaft is rotatably mounted in the known manner in conventional anti-friction bearing assemblies 87 secured in the vertically disposed bearing carrier housing 90 which terminates at its upper end in an enlarged motor support surface 91. The bearing carrier housing 90 is rigidly secured to an attaching plate 89 by means of a series of circumferentially spaced, vertically positioned anti-vortex plates 92 welded therebetween. Attaching plate 89 is secured by bolts 89A to the previously described mounting plate 50. An adjusting collar 89B (FIGS. 3 and 4) is adjustably bolted to plate 89 by bolts 89C which pass through slots 89D in collar 89B.

A lid 92A is secured across the top edge of plates 92 to prevent water from splashing into the intake air conduit 122 for the vacuum pump, as will appear.

Figure 6:
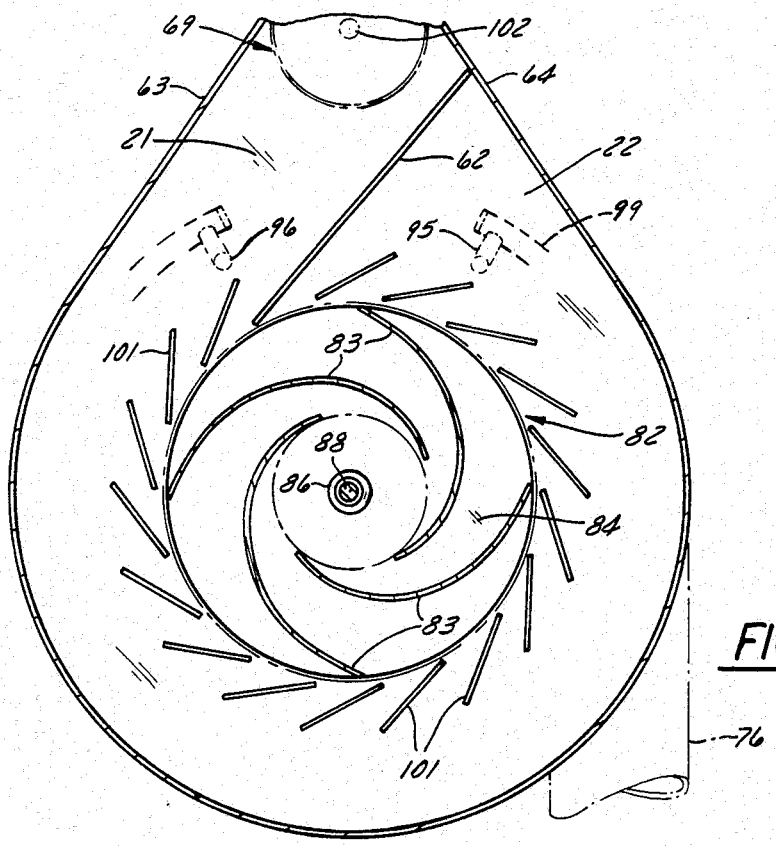
FIG. 6 is a horizontal cross-sectional view taken generally along line 6—6 in FIG. 3.

The pump discharge chamber 22 includes the tear-shaped bottom 21, vertical side wall 63 and upper side wall 49. A water directing baffle plate 62 (FIG. 6) extends across part of the chamber and into the extending portion 64 and serves to direct the water from the impeller to the outlet. A portion 64 of chamber 22 extends outwardly beyond the radial dimension of the cylindrical tank. Mounted on the top side of the extending portion 64 is a water discharge mechanism including a one-way valve 69 and a conventional swivel joint 70. This mechanism includes an upstanding nipple 71 which is welded to the upper side wall 49 and which also has an annular flange 72 welded around its upper end. A multi-legged spider 73 has a flange 74 welded thereto and a stainless steel sealing ring seat 75 is welded around the upper inner edge of the flange 74. A pipe reducer 77 is welded at its lower end to a ring-plate flange 78 and aligned apertures in flanges 72, 74 and 78 receive bolt means for securing the mechanism thereto. The spider 73 has a central bearing member 79 in which is slidably mounted the central stem 102 of the shiftable valve disc 103 which is bolted to the upper end of the stem. A rubber gasket 104 is fixed by a plate 105 to the lower surface of the valve disc 103 and this rubber gasket seats against the stainless steel seat 75, when the valve is in the closed position. Thus, water discharged by the pump forces the valve upwardly and the water passes through the reducer 77 and out of the swivelly mounted discharge elbow 110. The swivel joint 70 may be of a conventional type such as a standard Dresser coupling which permits the directional discharge from the apparatus. This swivel joint is particularly useful because rigid pipes are usually used to convey the water being discharged.

Figure 4:
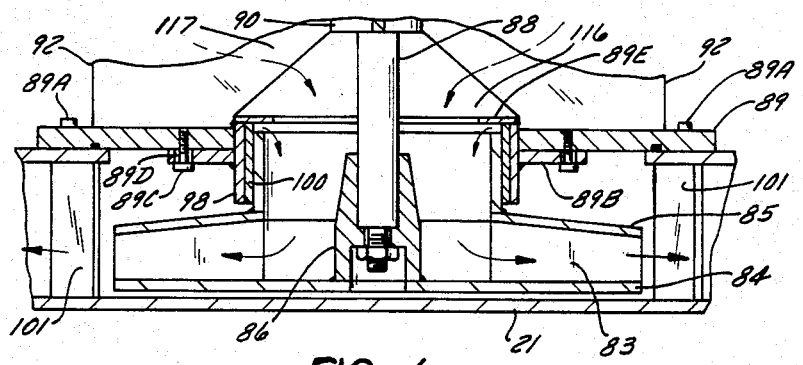
FIG. 4 is an enlarged fragmentary view of the pump as shown in the lower portion of FIG. 3.
Figure 3:
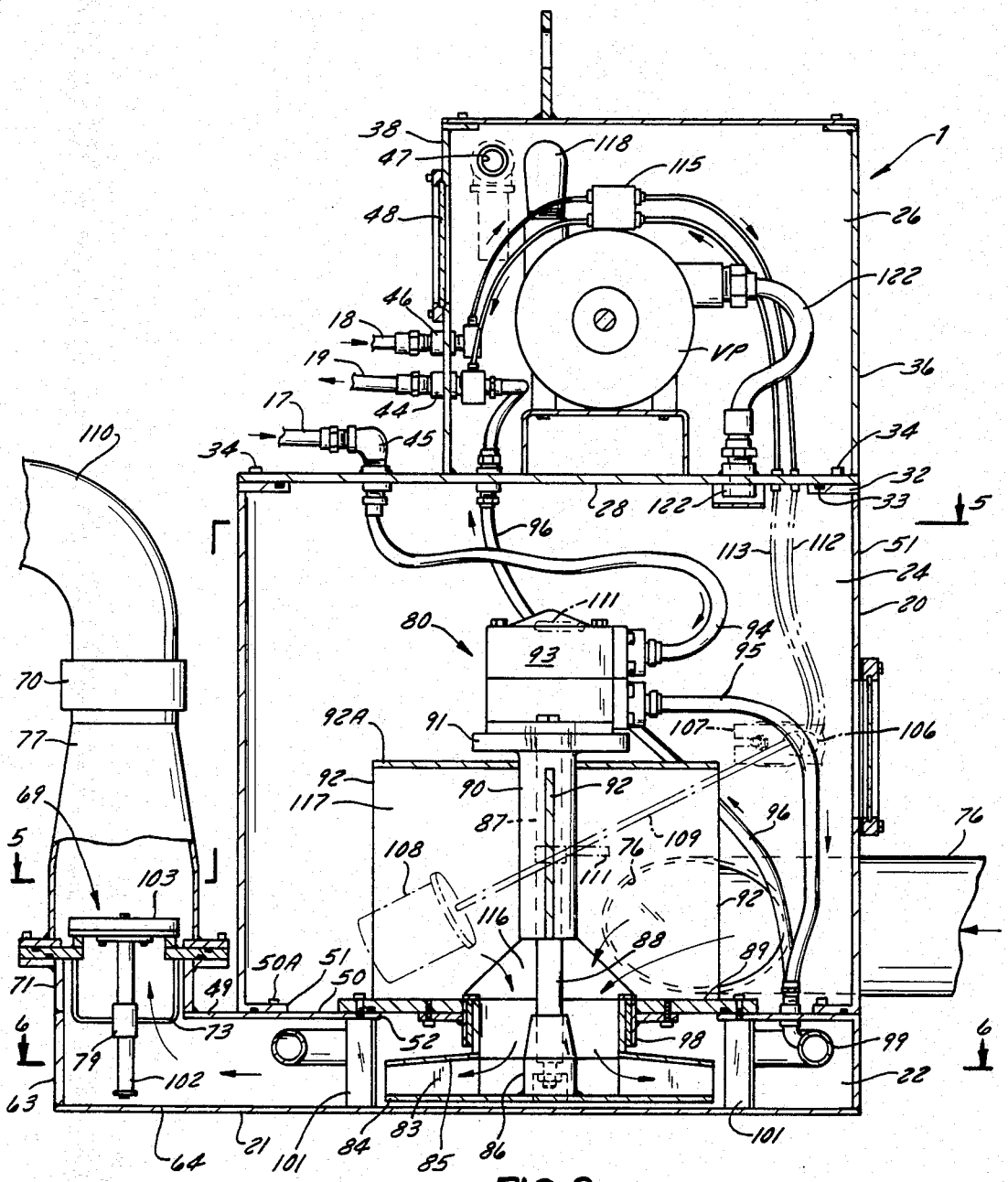
FIG. 3 is a vertical cross-sectional view taken through the apparatus shown in FIG. 2 but on an enlarged scale, certain parts being shown as broken away or removed for the sake of clarity.

As shown clearly in FIGS. 3 and 4, leakage deflector means are provided for preventing water from going up into the inlet chamber 24 after being discharged by the impeller pump. This deflector means takes the form of a ring-like cover plate 89E welded to the top edge of a collar 98, which is welded to a central opening in adjusting plate 89B. Plate 89 deflects water back down in the eye of the pump. A brass liner 100 is press fit in collar 98.

Impeller driving means in the form of a vane type fluid motor 93, for example, is secured on the enlarged support surface 91 and is connected to the upper end of the shaft 88 whereby the fluid motor can rotatably drive the impeller. Vane motor 93 is of conventional form and may be of the type made by Vickers Manufacturing Company. This fluid motor 93 is also connected by conduit 95 (FIGS. 3 and 10) to an oil cooler conduit means 99 located in the lower pump chamber 22. Other forms of power for driving the impeller may be used such as, for example, a gear drive, an electric submersible pump or other forms.

A series of circumferentially spaced, fixed vanes 101 are secured to the underside of mounting plate 50 and act to receive the water that is discharged by the impeller, and acts as a diffusor and "straightens" out the flow of water.

The closed impeller pump assembly 80 (FIG. 9) can be assembled as a unit and its various parts adjusted relative to one another with proper tolerances. The assembly can be installed and removed as a unit and minimum maintenance is required.

Also located within the inlet chamber 24 is a remote speed control valve 106 (FIGS. 3, 5 and 10) for regulating the speed of the vacuum pump VP located in the upper vacuum chamber 26. The speed control valve 106 is rigidly mounted to the interior of the tank by bracket 107 and is actuated by the float 108 attached to arm 109, movement of which in turn actuates the control valve 106. Stops 111 (FIG. 5) limit the movement of the float 108 which, of course, is under the influence of the water level in inlet chamber 24. The valve 106 is connected by pressure fluid conduit 112 and fluid return conduit 113 (FIG. 3) which extend through plate 28 and which are connected to the modulating hydraulic valve 115 (FIGS. 8 and 10) located in the upper chamber 26, as will appear. A fixed orifice 114 (FIG. 10) between conduits 112 and 113 assures minumum speed. The oil, when not needed, flows through conduit 113A from regulating valve 115. If valve 115 is closed, then fluid flow goes from conduit 18 through motor 127 and controls the amount of flow through the motor. If valve 115 is open, the pressure fluid from conduit 18 goes to the pump via conduit 113A and outlet conduit 19. The valve 115 is thus a continuously modulating, adjustable preset valve. This pilot operated relief valve 115 dumps the pressure fluid from driving the vacuum pump when the float 108 rises sufficiently to actuate its valve 106, thereby modulating the pumping action of the vacuum pump. Preferably the vacuum pump is never shut off completely in order to maintain a flow of cooling and lubricating oil through it.

Water is delivered via nipple 76 and floods the inlet chamber 24 so that the water flows downwardly by gravity and into the eye area 116 of the pump impeller. In this manner the pump is always flooded with water, and water flows (Fig. 4) in the general direction of the broken-line arrows into the impeller. If the incoming volume of water is not sufficient to completely cover the impeller eye 116 (FIGS. 3 and 4), the impeller will not lose its pumping ability as do impellers with horizontally disposed axes. A vertical axis impeller with a downwardly facing eye will also lose its pumping ability with low incoming volume of fluid. This results in a "surging" pumping action in which the outlet flow drops to about zero and the impeller torque requirement drops to a very low level relative to flooded impeller (primed) requirements. This surging action causes many undesirable effects, both mechanical and output oriented.

A major mechanical problem is that the pump seal is alternately pressurized while pumping and then subjected to negative pressure (vacuum) while not pumping. With the present arrangement, this problem is eliminated by installing the shaft 88 vertically within the vacuum chamber 24 where it is subjected to negative pressure only and it is limited to −14.7 psi maximum. Furthermore, the shaft seal and bearing support carrier are so placed so they have no communication with the posivite head producing side of the impeller. In other words, a void is created in the area of the shaft bearings in the housing 90 which prevents water surging. Little water pressure, if any, is present in the substantially pressure-free zone 117 (FIGS. 3 and 4). As a result, sophisticated bearings are not needed for the pump shaft, such as ground face mechanical seals.

Water is discharged radially by the impeller and into chamber 22 creating a water pressure in the chamber. This water then flows out the one-way check valve 69 and out the discharge outlet 110.

Water is initially inducted into the inlet chamber 24 from the well points and connecting conduit means by means of a vacuum pump VP located in the upper pump chamber 26. The inlet of the pump is connected to inlet chamber 24 by the air conduit 122 (FIGS. 3 and 8), and thus the vacuum pump creates a partial vacuum in the inlet chamber 24 thus causing water to be inducted into the inlet chamber 24. The vacuum pump VP is, for example, of the sliding vane type which is constantly flooded with oil via conduits 60 and 61 to thereby continually lubricate and cool the vacuum pump. The air is discharged from the vacuum pump VP along with the cooling oil via the discharge conduit 118 into the vacuum pump chamber 26 where the oil is separated from the air. That is to say, the oil separates from the air and falls to chamber 26 and to oil reservoir 54 (FIGS. 5 & 10) containing float 120, valve 121 and stop 122.

Figure 10:
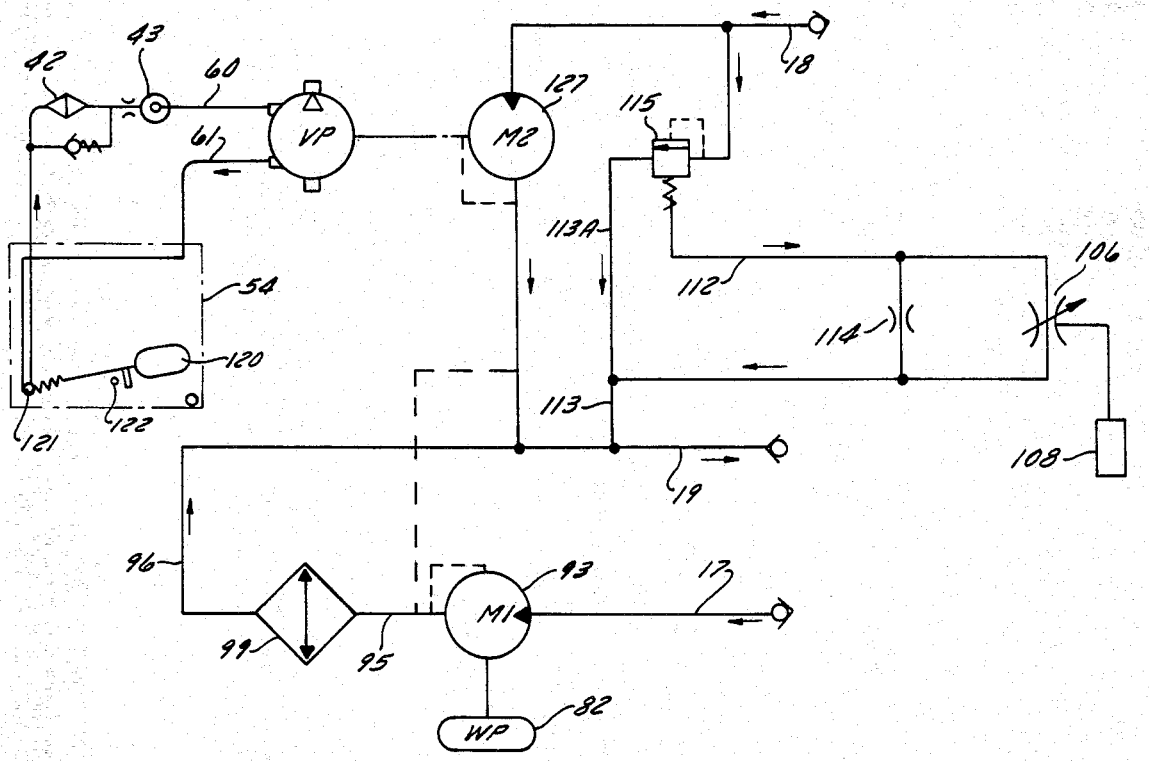
FIG. 10 is a combined hydraulic diagram of the apparatus of the present invention.
Figure 7:
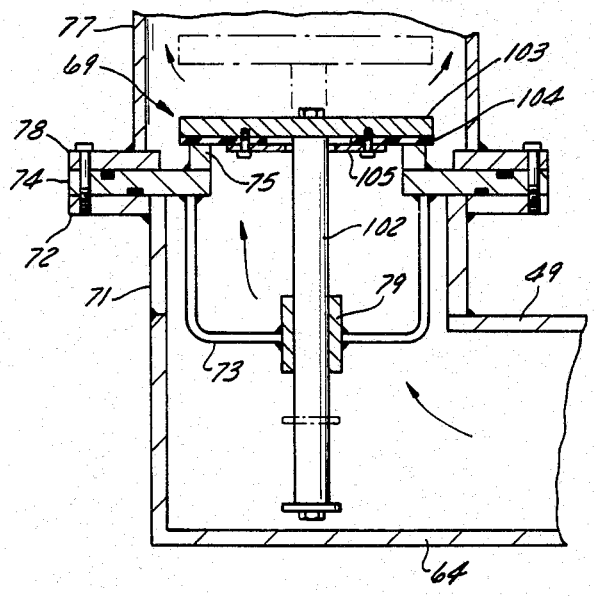
FIG. 7 is a fragmentary, enlarged perspective view of the one-way check valve for the water discharge from the apparatus.
Figure 8:
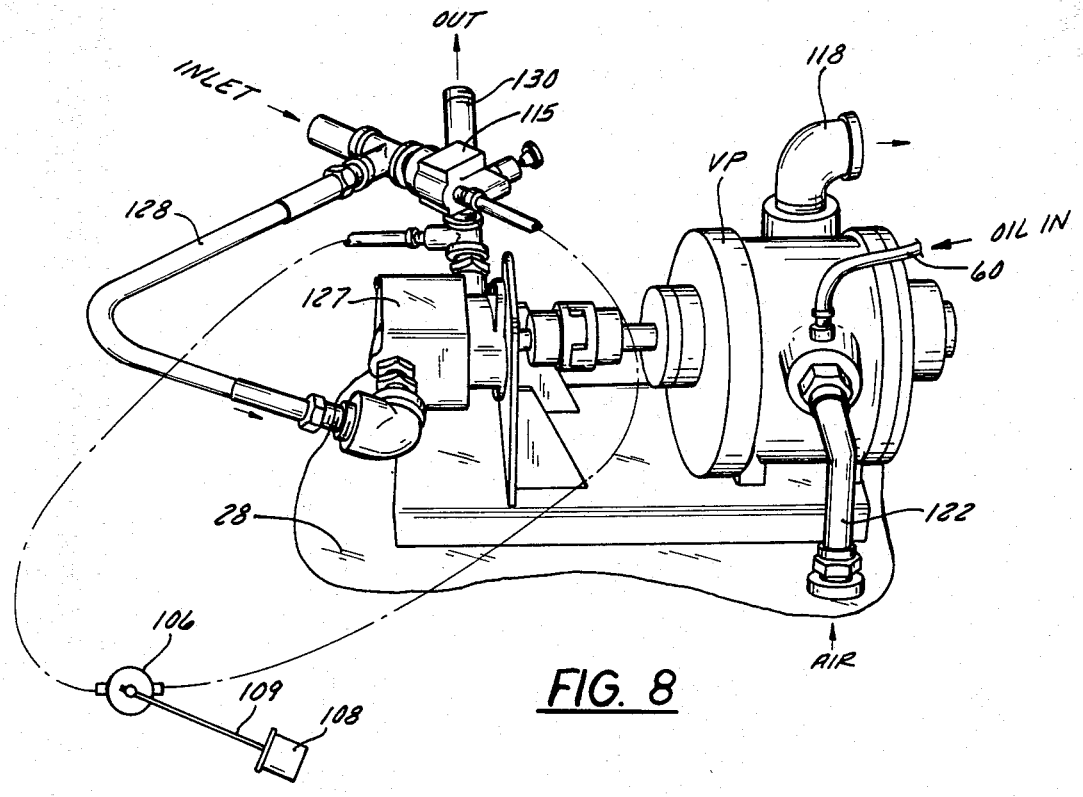
FIG. 8 is a perspective view of the vacuum pump, its motor, and a hydraulic control valve for regulating the speed of the vacuum pump, the vacuum pump also being shown in FIG. 3.
Figure 9:
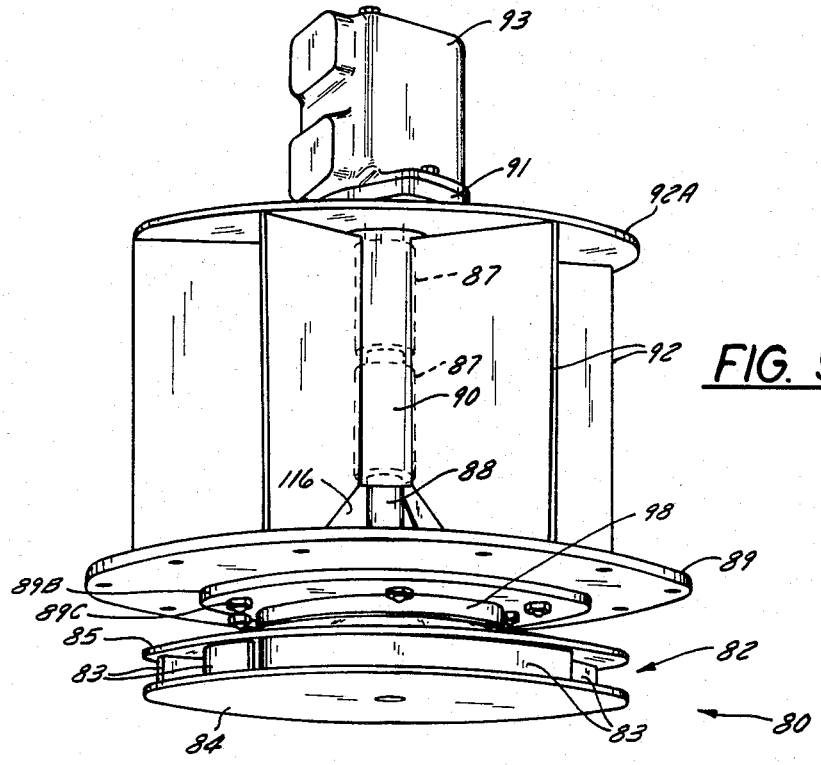
FIG. 9 is a perspective view of the closed impeller type pump assembly, the assembly also being shown in FIGS. 3 and 5 and partially in FIG. 4.

As shown clearly in FIGS. 8 and 10, the vacuum pump VP is driven by the hydraulic motor 127. Pressure fluid from the hydraulic pump 12 of the power source 10 is conducted via conduit 18 to motor 127 and also to the hydraulic valve 115. Fluid is discharged from the motor 127 via the discharge conduit 19 and is returned to the power source 10.

The throttle sensitive vacuum pump VP is thus enclosed in chamber 26 and a mixture of oil mist and air swirls around the chamber 26 and acts to keep the pump at an even temperature, and thus avoids rapid temperature changes. Enclosing the vacuum pump also renders it tamper proof and helps lower the sound level.

Oil which is continually passing through the vacuum pump lubricates the entire system, including bearings, and it acts to seal the vanes of the pump for good pumping efficiency, and it acts to transfer and dissipate heat.

The present apparatus provides separate controls for the vacuum pump VP and the main water pump assembly 80. Consequently, it is possible to fill the system with water by using the vacuum pump only, avoiding running the water pump in a dry condition until the system is filled with water.

I claim:

1. A hydraulic well point pumping system comprising conduit means extending over an area of ground to be drained of water and having well point means extending into the ground for extracting water therefrom, water pump apparatus connected to said conduit means for pumping water from said conduit means, said apparatus comprising an enclosed tank locatable adjacent said well point means and having a water inlet and a water outlet, a closed impeller type water pump assembly in said tank and including a pump having an impeller and a shaft fixed thereto and rotatable about a vertical axis, said pump having an inlet eye facing in an upward direction for the reception of gravity-fed water downwardly into said impeller, said impeller shaft extending upwardly and having an upper end, and a hydraulically driven fluid motor secured to said shaft upper end for rotatably driving said impeller about said vertical axis, fluid passage means between the discharge of said pump impeller and said outlet of said tank, one-way check valve means at said discharge of said impeller, said tank also including a vacuum pump chamber in said tank and having a vacuum pump therein for creating said vacuum in said tank to thereby induct water into said tank through said inlet, and means for driving said vacuum pump, a remote speed control valve for regulating the speed of said vacuum pump, float control means in said tank, for actuating said remote speed control valve, and a power source means locatable remotely from said tank and including a power driven hydraulic pump, and conduit means connected between said power driven hydraulic pump and said fluid motor of said impeller in said tank whereby said pump can remotely drive said motor.

2. The system set forth in claim 1 further characterized in that said tank has a mounting plate rigidly secured therein and in a generally horizontal direction and adjacent the bottom of said tank, said mounting plate having a central opening therethrough, said water pump assembly also having an attaching plate, said impeller being received downwardly through said mounting plate central opening, and means for rigidly, sealingly, and removably securing said attaching plate to said mounting plate.

3. The system set forth in claim 2 including a bearing carrier housing for rotatably supporting said impeller shaft and also for supporting said fluid motor, and anti-vortex plates rigidly secured to and between said bearing carrier housing and said attaching plate for rotatably supporting said impeller and its shaft relative to said attaching plate whereby said water pump assembly can be removed as a unit from said tank.

4. The system set forth in claim 3 including a water leakage deflecter fixed around said central opening in said mounting plate to prevent water pumped by said impeller from flowing upwardly in said tank.

5. The system set forth in claim 2 further characterized in that said mounting plate has a series of circumferentially spaced water directing vanes rigidly secured to its underside, said vanes surrounding said impeller and for receiving and diffusing water discharged by said impeller.

6. Hydraulic well point pumping apparatus comprising:

an enclosed tank having a water inlet and a water outlet, a closed impeller type water pump assembly in said tank and having a vertical axis of rotation, said water pump assembly having an impeller rotatable about said vertical axis and having an inlet eye facing in an upward direction for the reception of water downwardly into said impeller and by gravity fed thereto, said impeller having an upwardly extending shaft fixed thereto, and a hydraulically driven fluid motor secured to said shaft for driving said impeller, fluid passage means between the discharge of said impeller and said outlet of said tank, one-way check valve means at said discharge of said impeller, said tank also including a vacuum pump chamber and a vacuum pump in said pump chamber for creating said vacuum in said tank to thereby induct water into said tank through said inlet, and means in said chamber for driving said vacuum pump, a remote speed control valve for turning said vacuum pump on and off and also for regulating the speed of said vacuum pump, and float control means in said tank for actuating said remote speed control valve.

7. The apparatus set forth in claim 6 including a power source means locatable remotely from said tank and including a power driven hydraulic pump, and conduit means connected between said power driven hydraulic pump and said fluid motor of said impeller in said tank whereby said pump can remotely drive said motor.

8. The apparatus set forth in claim 6 further characterized in that said tank has a mounting plate rigidly secured therein and in a generally horizontal direction and adjacent the bottom of said tank, said mounting plate having a central opening therethrough, said water pump assembly also having an attaching plate, said impeller being received downwardly through said mounting plate central opening, and means for rigidly, sealingly, and removably securing said attaching plate to said mounting plate.

9. The apparatus set forth in claim 8 including a bearing carrier housing for rotatably supporting said impeller shaft and also for supporting said fluid motor, and anti-vortex plates rigidly secured to and between said bearing carrier housing and said attaching plate for rotatably supporting said impeller and its shaft relative to said attaching plate whereby said water pump assembly can be removed as a unit from said tank.

10. The apparatus set forth in claim 9 including a water leakage deflector fixed around said central opening in said nounting plate to prevent water pumped by said impeller from flowing upwardly in said tank.

11. The system set forth in claim 7 further characterized in that said mounting plate has a series of circumferentially spaced water directing vanes rigidly secured to its underside, said vanes surrounding said impeller and for receiving and diffusing water discharged by said impeller.

12. An enclosed tank for water pumping apparatus and having a water inlet and a water outlet; said tank having a lower water pump chamber, an upper vacuum pump chamber, and an intermediate water inlet chamber, a closed impeller type water pump assembly in said tank and having a vertical axis of rotation, said water pump assembly having an impeller in said lower water pump chamber and rotatable about said vertical axis; said water pump assembly having an inlet eye opening in an upward direction and into said intermediate water inlet chamber for receiving water downwardly by gravity and into said impeller, said impeller having a shaft fixed thereto and extending upwardly into said intermediate chamber, and a hydraulically driven fluid motor in said intermediate chamber and secured to said shaft for driving said impeller, a vacuum pump in said upper chamber for creating a vacuum in said intermediate chamber to thereby induct water into said tank through said water inlet located in said intermediate chamber, a remote speed control valve in said intermediate water inlet chamber for regulating the speed of said vacuum pump, and float control means in said intermediate chamber for actuating said remote speed control valve in accordance with a water level in said intermediate chamber.

13. The apparatus set forth in claim 12 further characterized in that said tank has a mounting plate rigidly secured therein and in a generally horizontal direction and located between said lower and intermediate chambers, said mounting plate having a central opening therethrough, said water pump assembly also having an attaching plate, said impeller being received downwardly through said mounting plate central opening, and means for rigidly, sealingly and removably securing said attaching plate to said mounting plate.

14. The apparatus set forth in claim 13 including a bearing carrier housing for rotatably supporting said impeller shaft and also for supporting said fluid motor, said anti-vortex plates rigidly secured to and between said bearing carrier housing and said attaching plate for rotatably supporting said impeller and its shaft relative to said attaching plate whereby said water pump assembly can be removed as a unit from said tank.

15. The apparatus set forth in claim 13 including a water leakage deflector fixed around said central opening in said mounting plate to prevent water in said lower chamber from flowing upwardly into said intermediate chamber.

16. The system set forth in claim 13 further characterized in that said mounting plate has a series of circumferentially spaced water directing vanes rigidly secured to its underside and located in said lower pump chamber and surrounding said impeller and for receiving and diffusing water discharged by said impeller.

17. Hydraulic well point pumping apparatus comprising:

enclosed tank means having a water inlet and a water outlet, said tank means having a water inlet chamber including a bottom, an impeller type water pump assembly in said water inlet chamber and having a vertical axis of rotation, said water pump assembly having an impeller rotatable about said vertical axis and having an inlet eye facing in an upward direction for the reception of water downwardly into said impeller and by gravity feed thereto, said impeller having an upwardly extending shaft fixed thereto, and means secured to said shaft for driving said impeller, fluid passage means between the water inlet chamber and said outlet of said tank means, said tank means also including a vacuum chamber, and a driven vacuum pump for creating vacuum in said tank means to thereby induct water into said water inlet chamber through said tank inlet, means for driving said vacuum pump, a remote control valve for regulating the capacity of said vacuum pump, float control means in said for causing actuation of said control vlave, said tank means having a mounting plate rigidly secured therein and in a generally horizontal direction and adjacent but vertically spaced from the bottom of said tank means, said mounting plate having a central opening therethrough, said water pump assembly also having an attaching plate, said impeller being received downwardly through said mounting plate central opening, and means for rigidly, sealingly, and removably securing said attaching Plate to said mounting plate.

18. The apparatus set forth in claim 17 including a power source means locatable remotely from said tank means and including a power driven hydraulic pump, said means for driving said impeller comprising a fluid motor, and conduit means connected between said power driven hydraulic pump and said fluid motor of said impeller whereby said pump can remotely drive said motor.

19. The apparatus set forth in claim 17 including a bearing carrier housing for rotatably supporting said impeller shaft and also for supporting said fluid motor, and anti-vortex plates rigidly secured to and between said bearing carrier housing and said attaching plate for rotatably supporting said impeller and its shaft relative to said attaching plate whereby said water pump assembly can be removed as a unit from said tank means.

20. A hydraulic well point pumping system comprising conduit means extending over an area of ground to be drained of water and having well point means extending into the ground for extracting water therefrom, water pump apparatus connected to said conduit means for pumping water from said conduit means, said apparatus comprising enclosed tank means having a water inlet and a water outlet, said tank means having a water inlet chamber including a bottom, an impeller type water pump assembly in said water inlet chamber and having a vertical axis of rotation, said water pump assembly having an impeller rotatable about said vertical axis and having an inlet eye facing in an upward direction for the reception of water downwardly into said impeller and by gravity feed thereto, said impeller having an upwardly extending shaft fixed thereto, and means secured to said shaft for driving said impeller, fluid passage means between the water inlet chamber and said outlet of said tank means, said tank means also including a vacuum chamber, and a driven pump for creating vacuum in said tank means to thereby induct water into said water inlet chamber through said tank inlet, means for driving said vacuum pump, a remote control valve for regulating the capacity of said vacuum pump, float control means in said tank for causing actuation of said control valve.

21. The apparatus set forth in claim 20 including a power source means locatable remotely from said tank means and including a power driven hydraulic pump, said means for driving said impeller comprising a fluid motor, and conduit means connected between said power driven hydraulic pump and said fluid motor of said impeller whereby said pump can remotely drive said motor.

22. The apparatus set forth in claim 20 further characterized in that said tank means has a mounting plate rigidly secured therein and in a generally horizontal direction and adjacent but vertically spaced from the bottom of said tank means, said mounting plate having a central opening therethrough, said water pump assembly also having an attaching plate, said impeller being received downwardly through said mounting plate central opening, and means for rigidly, sealingly, and removably securing said attaching plate to said mounting plate.

* * * * *